US008263887B2

(12) United States Patent
Chen et al.

(10) Patent No.: US 8,263,887 B2
(45) **Date of Patent: *Sep. 11, 2012**

(54) BACKLIT KEY ASSEMBLY HAVING A REDUCED THICKNESS

(75) Inventors: Chao Chen, Waterloo (CA); Jana Lynn Papke, Waterloo (CA); Dietmar Frank Wennemer, Waterloo (CA)

(73) Assignee: Research In Motion Limited, Waterloo (CA)

( * ) Notice: Subject to any disclaimer, the term of this patent is extended or adjusted under 35 U.S.C. 154(b) by 369 days.

This patent is subject to a terminal disclaimer.

(21) Appl. No.: 12/560,511

(22) Filed: Sep. 16, 2009

(65) Prior Publication Data

US 2010/0213041 A1 Aug. 26, 2010

Related U.S. Application Data

(63) Continuation-in-part of application No. 12/393,153, filed on Feb. 26, 2009.

(51) Int. Cl.
*H01H 9/00* (2006.01)

(52) U.S. Cl. ..... 200/310; 200/516

(58) Field of Classification Search ..... 200/314, 200/310, 512, 516, 520

See application file for complete search history.

(56) References Cited

U.S. PATENT DOCUMENTS

| | | | | |
|---|---|---|---|---|
| 4,170,104 | A | 10/1979 | Yamagata | |
| 5,573,107 | A | 11/1996 | Nakano et al. | |
| 5,664,667 | A | 9/1997 | Kenmochi | |
| 5,711,588 | A | 1/1998 | Rudisill | |
| 6,738,475 | B1 | 5/2004 | Lieber | |
| 6,876,149 | B2 | 4/2005 | Miyashita | |
| 6,997,527 | B2 * | 2/2006 | Cheng | 312/332.1 |
| 7,070,349 | B2 | 7/2006 | Dombrowski et al. | |
| 7,360,957 | B2 | 4/2008 | Dombrowski et al. | |
| 7,671,290 | B2 | 3/2010 | Chen et al. | |
| 7,690,803 | B2 * | 4/2010 | Miyashita et al. | 362/27 |
| 7,825,899 | B2 | 11/2010 | Chen | |
| 7,935,404 | B2 | 5/2011 | Field et al. | |
| 2005/0281605 | A1 | 12/2005 | Dombrowski et al. | |
| 2007/0039809 | A1 | 2/2007 | Aihara et al. | |
| 2008/0018499 | A1 | 1/2008 | Chang | |
| 2008/0031673 | A1 | 2/2008 | Chang et al. | |

(Continued)

FOREIGN PATENT DOCUMENTS

DE 196 46 513 5/1998

(Continued)

OTHER PUBLICATIONS

EESR dated Nov. 2, 2009, corresponding EP patent application No. 09171439.4.

(Continued)

*Primary Examiner* — Xuong Chung Trans
(74) *Attorney, Agent, or Firm* — Ridout & Maybee LLP

(57) ABSTRACT

A backlit key assembly having a reduced thickness for an electronic device, and an electronic device having such a backlit key assembly are provided. The key assembly utilizes a local sink (recess) in a backing plate of the key assembly to lower the light source (e.g. LED) and flexible printed circuit board relative to the backing plate. The key assembly described herein provides a suitable leading space for the light source while permitting the overall thickness of the key assembly to be reduced compared with conventional backlit key designs.

24 Claims, 6 Drawing Sheets

U.S. PATENT DOCUMENTS

| | | | |
|---|---|---|---|
| 2008/0037277 | A1 | 2/2008 | Yamaguchi |
| 2008/0094373 | A1 | 4/2008 | Song |
| 2008/0197005 | A1 | 8/2008 | Bu |
| 2009/0122558 | A1 | 5/2009 | Tsai et al. |

FOREIGN PATENT DOCUMENTS

| | | | |
|---|---|---|---|
| DE | 19646513 | A1 | 5/1998 |
| EP | 0 845 795 | A | 6/1998 |
| EP | 0845795 | | 6/1998 |
| EP | 1 350 826 | A | 10/2003 |
| EP | 1350826 | | 10/2003 |
| EP | 0845795 | B1 | 1/2004 |
| EP | 1450385 | | 8/2004 |
| EP | 1450385 | A | 8/2004 |
| EP | 1739934 | | 1/2007 |
| EP | 1 758 139 | A | 2/2007 |
| EP | 1758139 | | 2/2007 |
| EP | 1758139 | A | 2/2007 |
| EP | 2031619 | | 12/2007 |
| EP | 1892737 | | 2/2008 |
| EP | 1892737 | A | 2/2008 |
| EP | 1918953 | | 5/2008 |
| EP | 1350826 | B1 | 11/2008 |
| EP | 2031619 | A | 3/2009 |
| GB | 2 366 761 | B1 | 1/2003 |
| GB | 2366761 | | 1/2003 |
| JP | 11 126536 | | 5/1999 |
| JP | 11 126536 | A | 5/1999 |
| JP | 11126536 | A | 5/1999 |
| JP | 2009 021108 | | 1/2009 |
| JP | 2009021108 | A | 1/2009 |
| WO | WO 03017300 | | 2/2003 |
| WO | WO 03017300 | A | 2/2003 |
| WO | WO 2007/100180 | A | 9/2007 |
| WO | WO 2007100180 | | 9/2007 |
| WO | WO 2007142211 | | 12/2007 |
| WO | WO 2007142211 | A | 12/2007 |

OTHER PUBLICATIONS

EESR, corresponding EP application No. 09153733.2, dated Jun. 24, 2009.
Silitech, "Multi-Image keypad", Liteon Group, Sep. 18, 2008.
EECO, Elastomer Series:Silicone Rubber Keypads, Oct. 17, 2007.
LED Light Guide Plate, http://xmcnblm.en.alibaba.com/product/209666732-200223007/LED_Light_Guide_Plate.html, at least as early as Mar. 12, 2009.
Keypad Light Guide, http://xmcnblrm.en.alibaba.com/product/207982581-200223007/Keypad_Light_Guide.html at least as early as Mar. 12, 2009.
European Search Report—Application No. 091537332.2 dated Jun. 24, 2009.
Extended European search report—EP App No. 09171439.4—Nov. 2, 2009.
LED Light Guide Plate: http://mxcnblm.en.alibaba.com/product/209666732-200223007/LED_Light_Guide_Plate.html, at least as early as Mar. 12, 2009.
Keypad Light Guide, http://xmcnblm.en.alibaba.com/product/207982581-200223007/keypad_light_guide_html.
MicroLens—Solutions for Keypad Backlighting, http://www.glthome.com/images/keypad0905.pdf, Mar. 11, 2006.
David DeAgazio, The MicroLens Concept: Backlighting with Fewer LEDs, 2006.
MicroLens Light Extraction, http://www.glthome.com/images/MicroLens-LightExtrct.PDF, Oct. 15, 2006.
Extended European Search Report—EP 11156716.0—Apr. 14, 2011.
Communication pursuant to article 94(3)—EP App No. 09153733.2—Oct. 1, 2010.
Extended European search report—EP App No. 09153733.2—Jun. 24, 2009.
Silitech—Multi-image keypad—liteon group—Sep. 18, 2008.
EECO—Elastomer series: silicone rubber keypads, Oct. 17, 2007.

* cited by examiner

BACKLIT KEY ASSEMBLY HAVING A REDUCED THICKNESS

RELATED APPLICATION DATA

This application is a continuation-in-part of U.S. patent application Ser. No. 12/393,153, filed Feb. 26, 2009, the content of which is incorporated herein by reference.

TECHNICAL FIELD

The present disclosure relates generally to input devices, particularly to key assemblies for handheld electronic devices, and more particularly to a backlit key assembly having a reduced thickness.

BACKGROUND

Keypads and keyboards in handheld electronic devices often include illuminated or "backlit" keys. Conventional mechanical and electronic components used to backlight a key increase the thickness of the keypad or keyboard compared to conventional keys without backlighting. This increased thickness typically results in a thick device profile which can be problematic for electronic devices which are designed to have progressively thinner profiles. In view of these and other deficiencies in keypad and keyboard designs, there remains a need for a backlit key assembly having a reduced thickness.

BRIEF DESCRIPTION OF THE DRAWINGS

Like reference numerals are used in the drawings to denote like elements and features.

DETAILED DESCRIPTION OF EXAMPLE EMBODIMENTS

Figure 1:
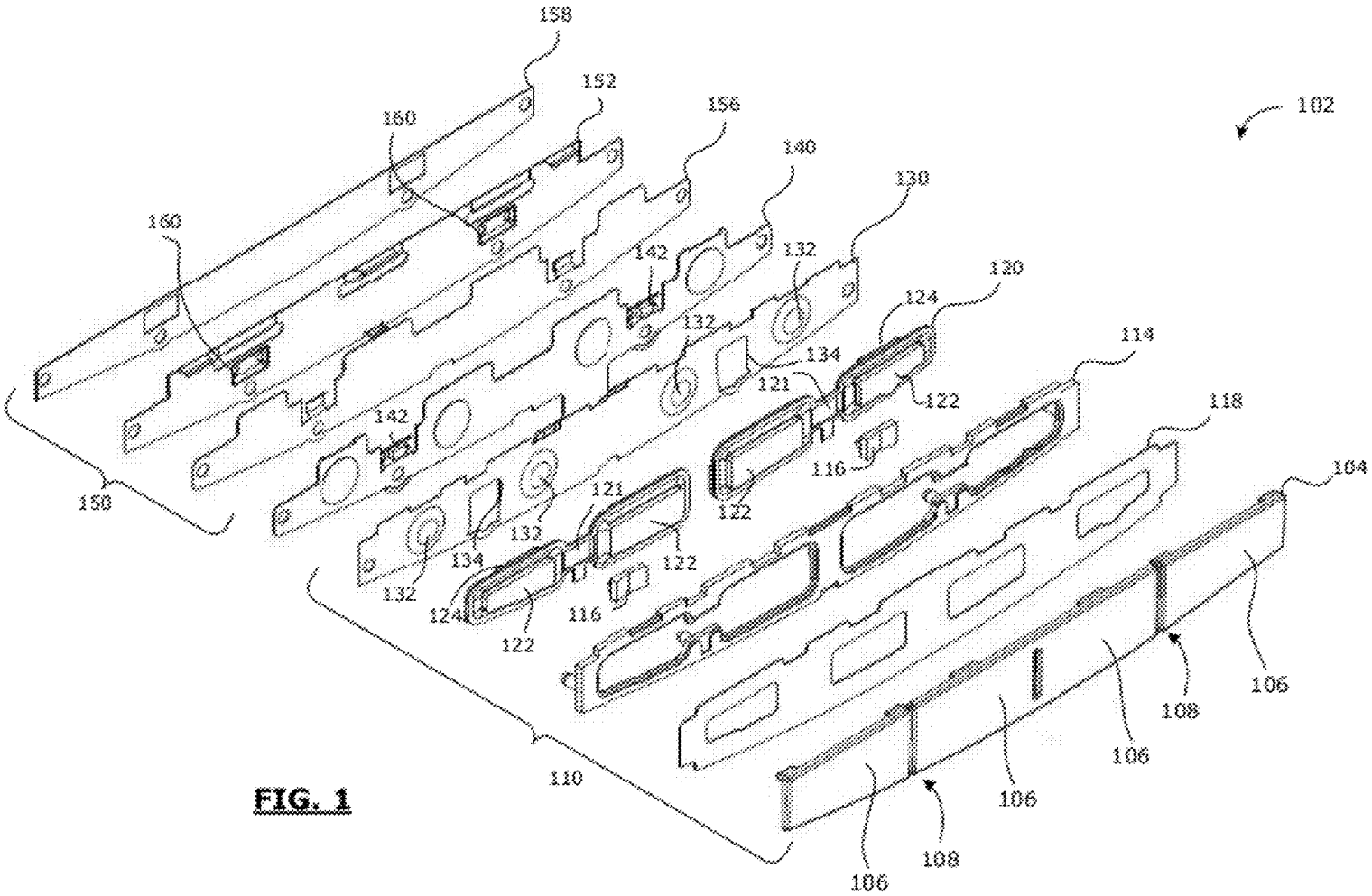
FIG. 1 is an exploded perspective view of a key assembly in accordance with one example embodiment of the present disclosure.
Figure 3:
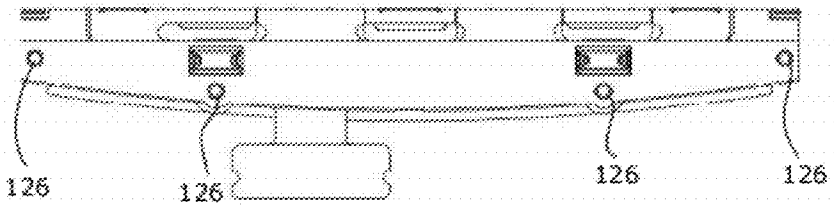
FIG. 3 is a bottom view of the key assembly of FIG. 1.
Figure 5:
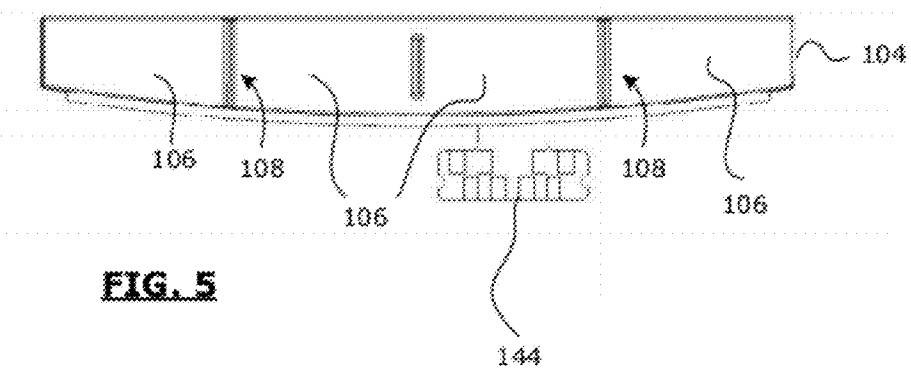
FIG. 5 is a top view of the key assembly of FIG. 1.
Figure 2:
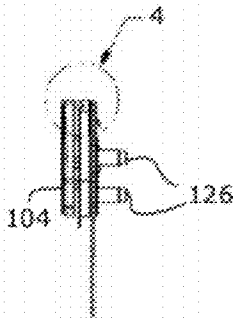
FIG. 2 is a side view of the key assembly of FIG. 1.
Figure 4:
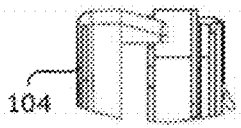
FIG. 4 is an enlarged view of the portion 4 of FIG. 2.
Figure 6:
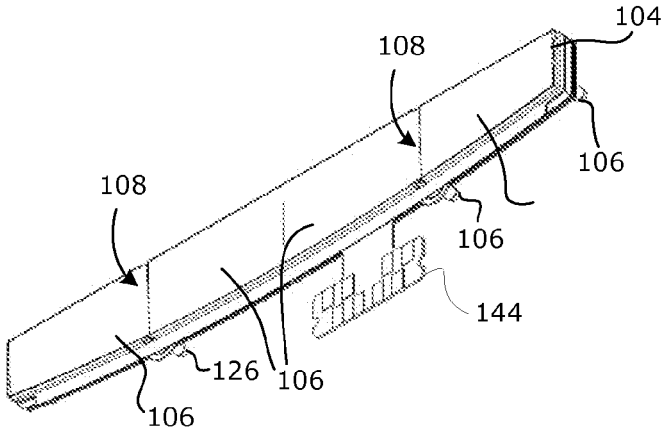
FIG. 6 is an alternate perspective view of the key assembly of FIG. 1.
Figure 7:
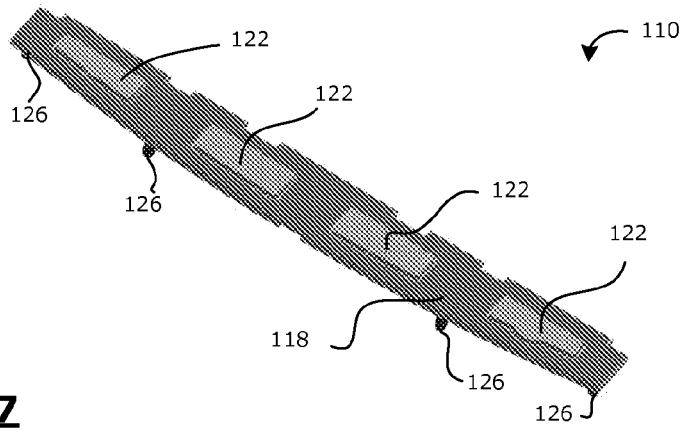
FIG. 7 is a perspective view of a portion of a key subassembly of the key assembly of FIG. 1 showing a light blocking film and the top of the key gluing stems.
Figure 8:
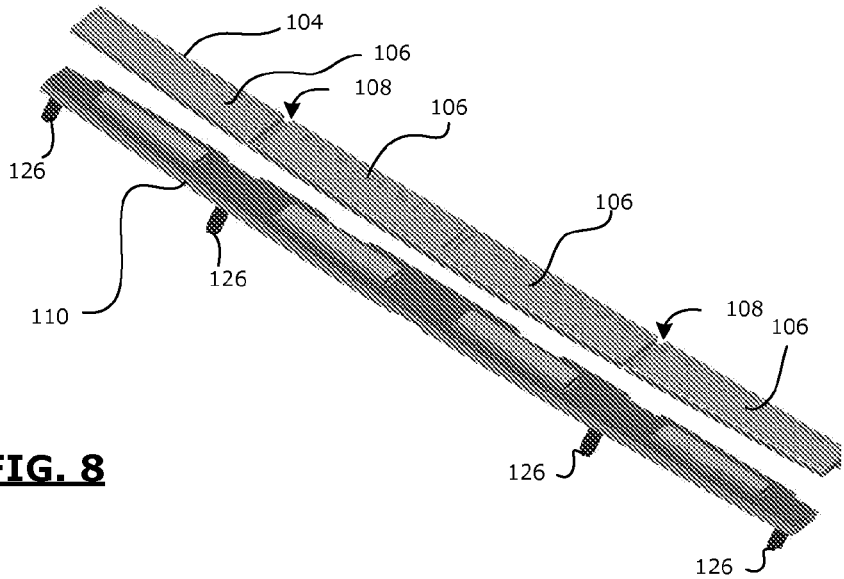
FIG. 8 is an alternate perspective view of the portion of the key subassembly shown in FIG. 7 with a one-piece keycap positioned thereabove.

The present disclosure provides a key assembly for a handheld electronic device (such as a mobile communication device) with backlit keys having a reduced thickness. The key assembly utilizes a local sink (recess) in a backing plate of the key assembly to lower the light source (e.g. LED) and flexible printed circuit board relative to the backing plate. The key assembly described herein provides a suitable leading space for the light source while permitting the overall thickness of the key assembly to be reduced compared with conventional backlit key designs.

In accordance with one embodiment of the present disclosure, there is provided a key assembly for use in an electronic device, comprising: a backing plate having a top surface which defines at least one recess; a key subassembly located above the top surface of the backing plate, including: a dome sheet having a number of dome switches on one side thereof; a flexible member formed of a light transmissive material having opposed first and second sides, the flexible member having a plurality of key stems located on the first side and a plurality of actuators located on the second side opposite the key stems and adjacent to the dome switches for actuating them; at least one keycap having a light transmitting portion attached to at least one of the key stems; and a flexible printed circuit board (PCB) received within the recess of the backing plate and connected to the dome sheet; a light emitting diode (LED) connected to the PCB; a light diffuser positioned opposite the LED having a light incident surface and at least one light emitting surface, wherein the light diffuser is configured to receive light from the LED when activated and direct the light towards the flexible member to illuminate it, wherein the illuminated flexible member emits at least a portion of the light received from the light diffuser through the light transmitting portion of the keycap to illuminate it.

In accordance with another embodiment of the present disclosure, there is provided an electronic device, comprising: a controller; a key assembly in accordance with the present disclosure which is connected to the controller; the controller being configured for receiving input signals in response to the actuation of the dome switches and for recognizing corresponding inputs in response to the received input signals.

The teachings of the present disclosure relate generally to handheld electronic devices such as mobile (e.g., wireless) communication devices including but not limited to pagers, cellular phones, Global Positioning System (GPS) navigation devices and other satellite navigation devices, smartphones, wireless organizers and wireless personal digital assistants (PDA). Alternatively, the handheld electronic devices could be a device without wireless communication capabilities such as a PDA, electronic gaming device, digital photograph album or picture frame, digital camera, or digital video recorder such as a camcorder. The handheld electronic device may comprise a touchscreen display as well as a keypad. It is also possible that the teachings of the present disclosure could be applied to electronic devices other than handheld electronic devices such as notebook computers. These examples are intended to be non-limiting.

Reference is first made to FIGS. 1 to 8 which illustrate a key assembly 102 for use in an electronic device in accordance with one embodiment of the present disclosure. The key assembly 102 comprises a keycap 104, a key subassembly 110, a dome sheet 130 comprising a number of domes switches 132, a flexible printed circuit board (PCB) 140 which is connected to the dome sheet 130, light emitting diodes (LEDs) 142 connected to the PCB 140, and a backing subassembly 150 for attaching the key assembly 102 to the host electronic device, for example, the handheld electronic device 201 (FIG. 11) described below. In the shown embodiment, the key assembly 102 is used in the construction of a control key panel or keypad for the front face of the handheld electronic device which may be a smartphone.

In the shown embodiment, a single one-piece keycap 104 is used. The one-piece keycap 104 has a plurality of hard key portions 106 separated by mechanically deforming portions 108. However, in other embodiments a series of individual keycaps could be used in which case the key portions 106 are each part of individual keycaps attached to the key gluing stems 122 described below. While the key portions 106 of the key assembly 102 in the shown embodiment are substantially similar in size and shape, in other embodiments the key portions 106 may be different in size, shape, or both. Moreover, while one dome switch 132 is provided for every key portion 106 in the keycap 104 of the shown embodiment, more or less than one dome switch 132 per key portion 106 could be used in other embodiments.

The keycap 104 is formed of a rigid plastic such as a rigid polycarbonate. The key portions 106 of the keycap 104 have a light transmitting portion 170 (FIG. 10) for transmitting light through the keycap 104. A light transmitting portion 170 is typically found in each key portion 106; however, in some embodiments it is possible that only some of the key portions 106 have a light transmitting portion 170. The light transmitting portion 170 is formed of a material having a light transmissive material (i.e. translucent or possibly transparent) suitable for transmitting light. This material may be the same material or different material as the rest of the keycap 104.

Figure 11:
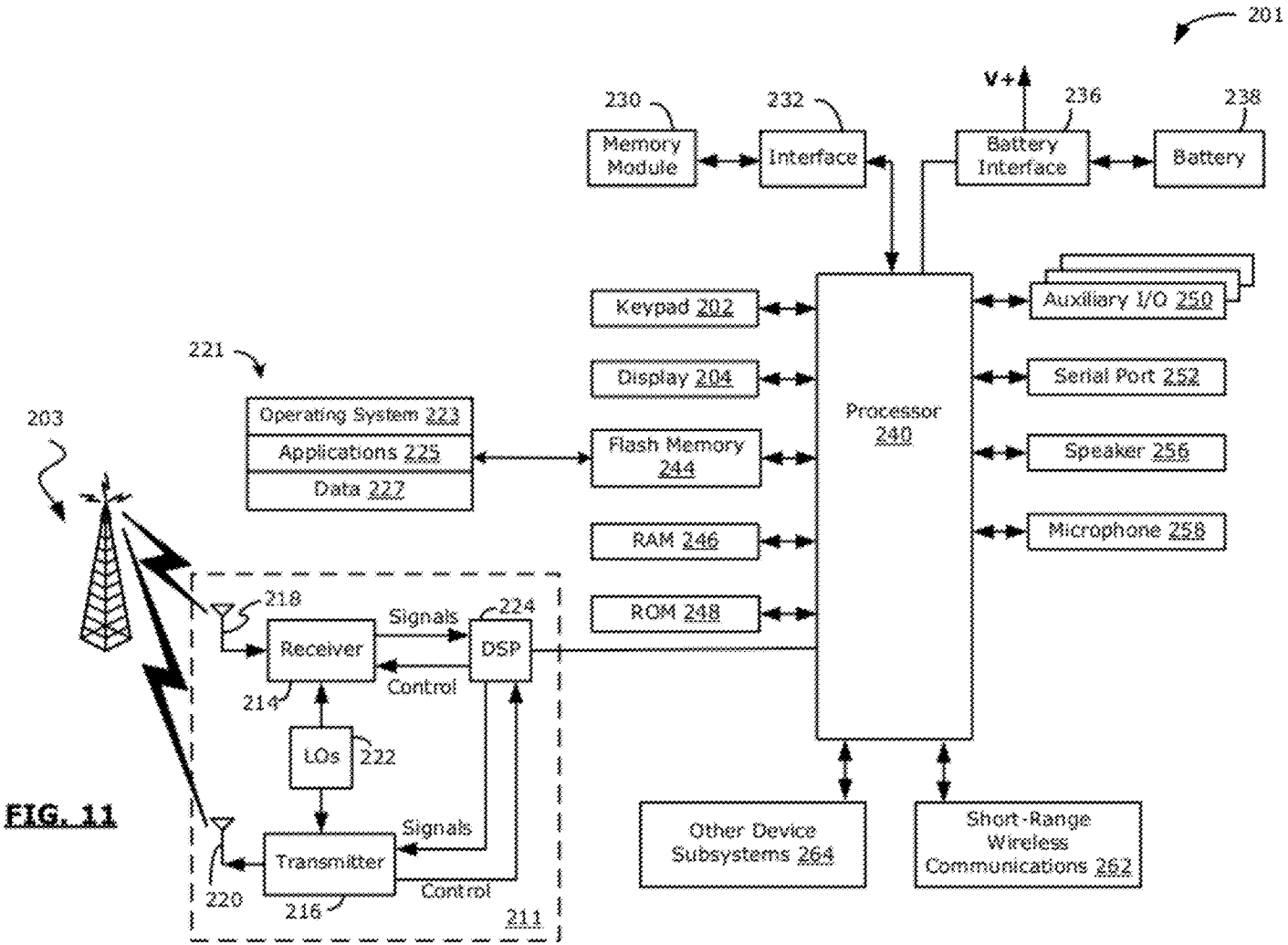
FIG. 11 is a block diagram illustrating a handheld electronic device in accordance with one example embodiment of the present disclosure.

In some embodiments, the keycap 104 is formed of a rigid and light transmissive material (i.e. translucent or possibly transparent) suitable for transmitting light such as a light diffusing polycarbonate (for example, polycarbonate L1225L) which is painted with a desired backlighting colour followed by a second color matching the device housing colour, and then laser-etched to remove a portion of the secondary paint to expose the backlighting colour. In some embodiments, the key portions 106 are painted a first colour which provides the colour of the backlight and then painted a second colour. The second colour can be selected to match the colour of the housing (not shown) of the host electronic device 201 (FIG. 11). The second colour is then laser-etched to expose the first colour. The laser-etching may form predefined shapes. The predefined shapes may be selected to provide a visual representation which provides the device user with an indication of a logical or programmatic function performed by activating/depressing the respective key of the host electronic device 201 (FIG. 11). The predefined shapes are typically different for each key portion 106.

The first colour may vary between key portions 106. When assembled into the host electronic device 201, the LEDs 142 may be activated to provide backlighting of the respective key portions 106 so as to illuminate the laser-etched shape in the first colour. The LEDs 142 may be activated whenever the host electronic device 201 (FIG. 11) is powered-on, or by specific triggers such as a predefined user setting, user input enabling the backlighting of the keys (for example, the depression of specialized key, predefined key or key combination), or the occurrence of predefined trigger events.

The key subassembly 110 comprises a pair of flexible members 120, a support member 114 and a pair of light diffusers 116. The flexible members 120 include actuators 124 for actuating the dome switches 132 of the dome sheet 130 as well as key gluing stems (key stems) 122 for attaching the flexible members 120 to the keycap 104. The flexible members 120 each define an opening 121 for receiving the light diffusers 116 during assembly. The light diffusers 116, when assembled into the key subassembly 110, are located adjacent to the flexible members 120 and the key cavities in which the actuators 124 of the flexible members 120 are received.

The flexible members 120 have opposed first and second sides. The key stems 122 are located on the first side and are attached to the underside of the key portions 106 of the keycap 104 using a suitable adhesive. The actuators 124 are located on the second side of the flexible members 120 opposite the key stems 122. The flexible members 120 bend or flex in response to depression of a corresponding key portion 106 of the keycap 104 in the assembled key assembly 102, thereby allowing key travel for actuation of a dome switch 132 opposite the corresponding actuator 124. The flexible members 120, actuators 124, key gluing stems (key stems) 122 and suitable adhesive are formed from a light transmissive material (i.e. translucent or possibly transparent) suitable for transmitting light. In the shown embodiment, actuators 124 and key stems 122 are provided in a 1:1 ratio; however, a different ratio could be utilized in other embodiments. While a pair of flexible members 120 is provided in the shown embodiment, a single flexible member 120 or multiple flexible members 120 could be used in other embodiments depending on the number and configuration of keys, and the configuration of the other parts of the key subassembly 110. The flexible members 120 are formed of a resilient deformable material which is suitable for transmitting light. In some embodiments, the material from which the flexible members 120 are formed is translucent silicon rubber 60, Shore A.

The support member 114 surrounds at least a portion of each of the key stems 122. In the shown embodiment, the support member 114 surrounds substantially the entirety of each of the key stems 122. The support member 114 is a rigid member which, in some embodiments, is formed of polycarbonate such as polycarbonate L1225L. The support member 114 includes or has attached thereto support pins 126 extending away from the keycap 104 for supporting the key assembly 102 and attaching it to the housing (not shown) of the host electronic device 201 (FIG. 11) along with the backing subassembly 150. The pins 126 are typically heat stake pins but could be alignment pins.

The support member 114 supports the key assembly 102 and prevents it from bowing out of the housing of the host electronic device 201 (FIG. 11) or deforming the key assembly 102. When a one-piece keycap is used, the support member 114 permits local flexing and deformation of the flexible members 120 and key portions 106 of the keycap 104. In the shown embodiment, the support member 114 is comolded with the flexible members 120, but could be disposed between the keycap 104 and the flexible members 120 or below the flexible members 120 provided it is properly adhered to the bottom of the flexible members 120.

Figure 9A:
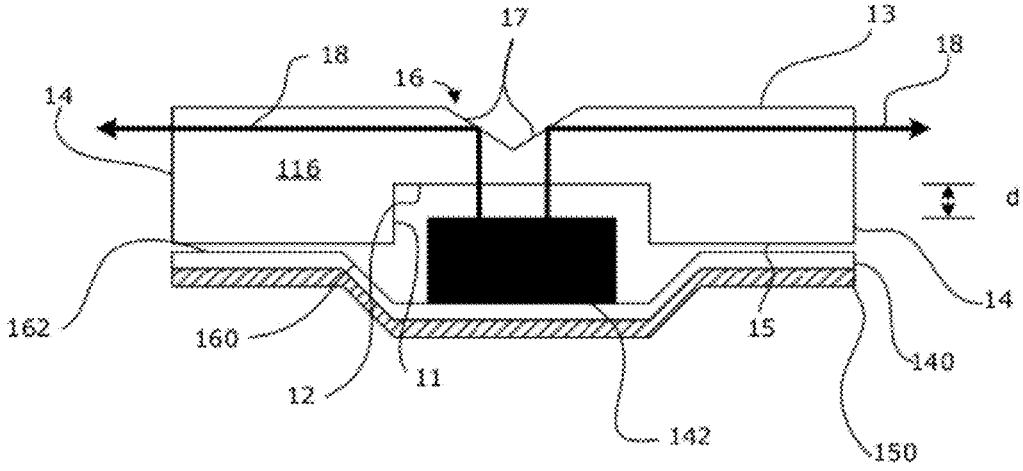
FIG. 9A is a schematic diagram showing a light diffuser of the key assembly of FIG. 1 in accordance with one example embodiment of the present disclosure.
Figure 9B:
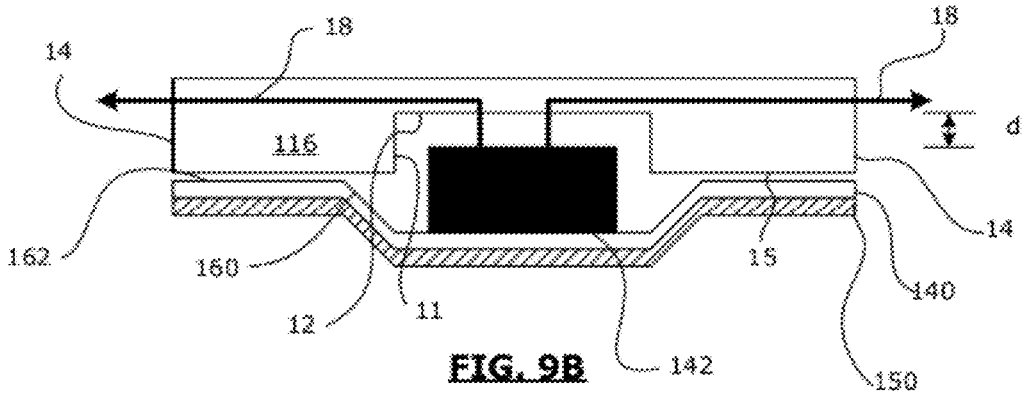
FIG. 9B is a schematic diagram showing a light diffuser of the key assembly of FIG. 1 in accordance with another example embodiment of the present disclosure.
Figure 10:
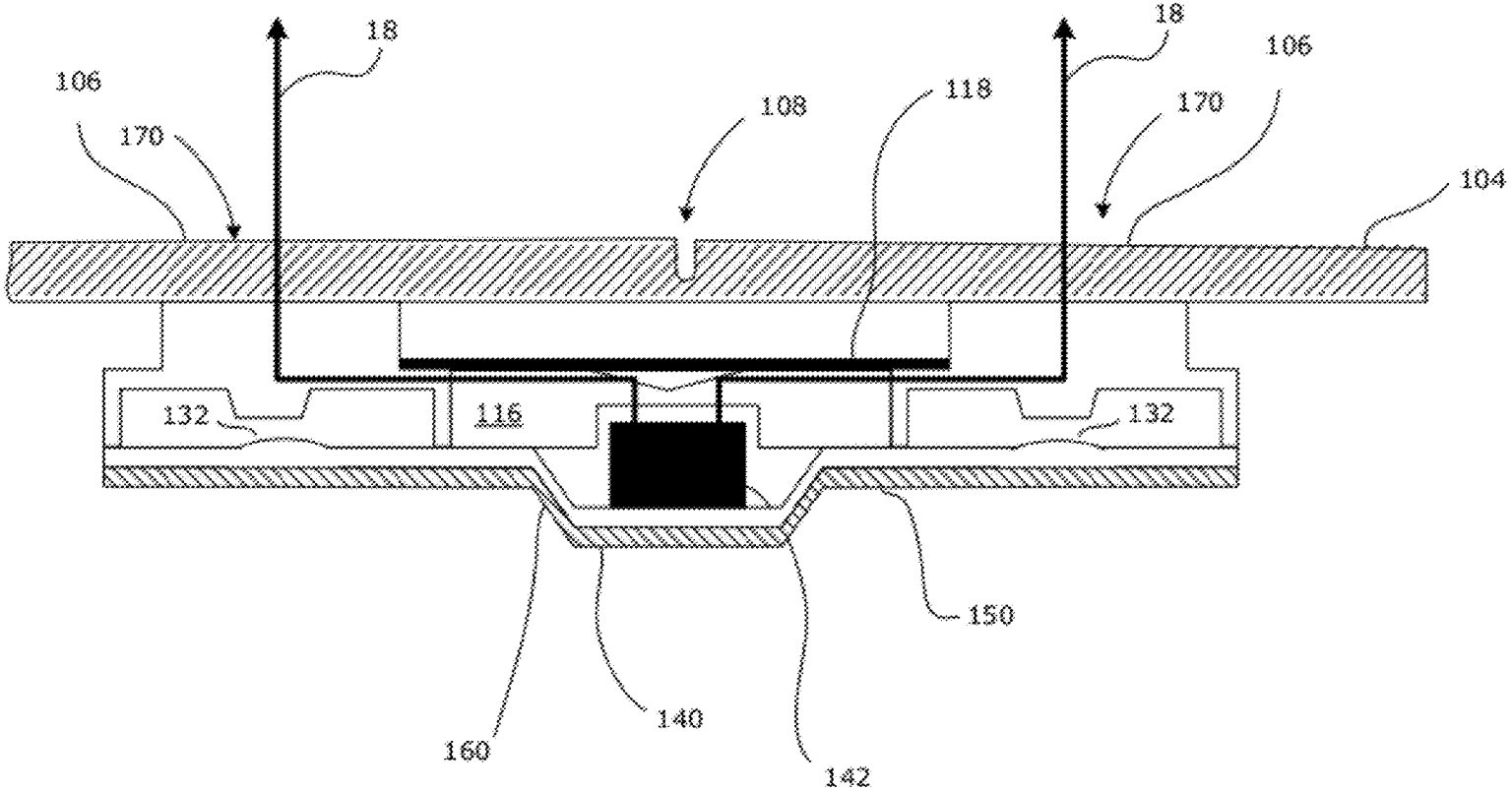
FIG. 10 is a schematic diagram showing the path of light rays through a light guide having the light diffuser of FIG. 9A.

The backing subassembly 150 comprises a substrate such as a backing plate 152, a first double-sided adhesive layer 156 and a second double-sided adhesive layer 158. In FIGS. 9A, 9B and 10 referred to below, the dome sheet 130, PCB 140 and first double-sided adhesive layer 156 are shown as one piece for the purpose of explanation; however, persons skilled in the art will appreciate that these are separate elements. In some embodiments, the double-sided adhesive layers 156 and 158 could be double-side electrical conductive adhesive types for electrical grounding the PCB 140 and dome switches 132 to a common device ground. The backing plate 152 is attached to the PCB 140 by the first double-sided adhesive layer 156. The backing plate 152 provides support for the PCB 140 as well as providing additional support and stiffening for the key assembly 102. The backing plate 152 is formed of metal in the shown embodiment, but could be formed of a rigid plastic in other embodiments. The backing plate 152 defines a pair of recesses 160 within a main portion 162 thereof. The dome sheet 130 is connected to the PCB 140 using respective contacts (not shown).

The PCB 140 is attached to the backing plate 152 within the recesses 160 as in other parts of the backing plate 152. As shown in FIG. 1, FIGS. 9A and 10, the LEDs 142 are connected to the PCB 140 within the recesses 160 of the backing plate 152. In some embodiments, projections (not shown) extending from the support member 114 press down and secure the PCB 140 and LEDs 142 within the recesses 160. The projections are received in corresponding openings (not shown) in the first double-sided adhesive 156 layer and backing plate 152.

The recesses 160 and LEDs 142 are positioned to avoid interference with the actuators 124 of the flexible member 120 when the dome switches 132 are actuated. In the shown embodiment, the LEDs 142 are positioned adjacent to the dome switches 132. The flexible PCB 140 also includes a communication interface 144 (FIGS. 5 and 6) for connecting to a communication interface (not shown) of the PCB (not shown) of the host electronic device for communicating with its controller 244 (FIG. 11).

In some embodiments, the recesses 160 are 0.33 mm in depth; however, the depth of the recesses 160 may vary between different embodiments of the key assembly of the present disclosure. The recesses 160 provide a mechanism by which the PCB 140 and LEDs 142 can be locally sunk relative to the main portion 162 of the backing plate 152. The second double-sided adhesive layer 158 defines openings 164 to accommodate enlarged areas on the rear surface of backing plate 152 caused by the recesses 160. This configuration allows the thickness of the key assembly 102 to be reduced compared with conventional LED backlit keys while providing the required LED firing space.

The heat stake pins 126 of the support member 114 extend through corresponding holes of the dome sheet 130, backing plate 152, first double-sided adhesive layer 156 and second double-sided adhesive layer 158. The heat stake pins 126 and second double-sided adhesive layer 158 attach the key assembly 102 to the device housing which, in some embodiments, has corresponding recesses for receiving the enlarged portions of the backing plate 152 caused by the recesses 160 and the heat stake pins 126. The first and second double-sided adhesive layers 156 and 158 are used for convenience of assembly. In other embodiments, the first and second double-sided adhesive layers 156 and 158 could be replaced with any suitable adhesive.

The dome sheet 130 comprises a number of dome switches 132 each comprising a polyethylene terephthalate (PET) film which overlays a collapsible metal dome having a nickel or silver plating over gold plating traces on a flexible PCB. As shown in FIG. 1, the dome sheet 130 also defines openings 134 allowing light from the LEDs 142 to pass therethrough. When a key portion 106 is pressed, the dome of the respective dome switch collapses thereby connecting the conductive platings and completing a connection therebetween. The controller of the host electronic device 201 receives an input signal in response to the connection of the conductive platings caused by actuation of the respective dome switch 132. The controller recognizes a corresponding input in response to the received input signal, which could be a character input or other input. In other embodiments, other dome switch constructions could be used.

Referring again to FIG. 1, a light blocking film 118 may be used in some embodiments. The light blocking film 118 is a black or otherwise opaque film or sheet (for example, a paper sheet). In the shown embodiment, the light blocking film 118 surrounds the entirety of the key stems 122; however, in other embodiments the light blocking film 118 surrounds only the periphery of the key subassembly 110 so that light is blocked from escaping from the periphery of the keycap 104. The light blocking film 118 may used when separate keycaps are used for the key assembly 102, but may be omitted when a one-piece keycap is used in some embodiments.

In other embodiments, the support member 114 could be shaped or otherwise configured to perform all of the light blocking thereby obviating the need for the light blocking film 118. In yet other embodiments, the light blocking film 118 could be shaped or otherwise configured to perform all of the light blocking so that the support member 114 need not be formed from a light blocking material in which case both the support member 114 and light diffusers 116 could be light transmissive (i.e. translucent or possibly transparent) and formed in a single-shot injection molding process. Alternatively, the light blocking film 118 could be replaced by painting of the surfaces surrounding the key stems 122 leaving the top of the key stems 122 unpainted to emit light therethrough. The light emitted from the top of the key stems 122 is received by the light transmitting portions 170 of the keycap 104 thereby providing the key backlighting.

Referring now to FIG. 9A, a light diffuser 116 in accordance with one embodiment of the present disclosure will be described. The light diffuser 116 is formed of a light diffusing material such as polycdrbonate L1225L. The light diffusing material of the light diffuser 116 distributes ("diffuses") light received from the LED 142 located opposite to it throughout the light diffuser 116. The light diffuser 116 includes a light incidence surface 12 which receives light emitted by an LED 142 located opposite the light diffuser 116, and one or more light emitting surfaces 14 for emitting light therefrom. Two or more light emitting surfaces 14 extend perpendicularly to the light incident surface 12 in the shown embodiment.

The light diffuser 116 also includes opposed top and bottom surfaces 13 and 15 respectively. The light incident surface 12 is provided in a recess 11 of the bottom surface 15 in the shown embodiment. The recess 11 allows the local thickness of the light diffuser 116 to be reduced while still providing the required leading spacing and without reducing the surface area of the light emitting surfaces 14. It will be appreciated that the amount of light emitted by the light diffuser 116 is affected by the surface area of the light emitting surfaces 14. If the surface area of the light emitting surfaces 14 is reduced, less light is transmitted to the flexible members 120 which results in less light being emitted through the keycap 104, thereby decreasing the brightness of the backlighting. In other embodiments, for example where thickness is less of a design constraint, the light incident surface 12 could be the entire bottom surface 15 of the light diffuser 116 or part of the bottom surface 15 at the expense of increased local thickness of the light diffuser 116. Alternatively, the overall thickness of the light diffuser 116 could be reduced to reduce the thickness of the light diffuser 116 at expense of reduced surface area for the light emitting surfaces 14 and reduced brightness of the backlighting.

In some embodiments, the top surface 13 of the light diffuser 116 could be a reflective surface to enhance the light diversion features of the light diffuser 116. Similarly, the bottom surface 15 of the light diffuser 116, or portions of the bottom surface 15, could be a reflective surface.

The light diffuser 116 also includes one or more light diversion features which, in the shown embodiment, are angular features 16 defined by a number of angled surfaces 17 positioned at an acute angle relative to the light incident surface 12. In other embodiments, light diversion features other than angular features 16 could be used for light diversion, or the light diversion features could be omitted. The light diversion features of the light diffuser 116, such as the angular features 16, are configured so as to cause light contacting these features to be emitted through the light emitting surfaces 14 in a direction generally perpendicular to the direction of the light received from the LEDs 142.

In the embodiment shown in FIG. 9A, the light diffuser 116 has an angular feature comprising a V-shaped trough or channel having a triangular cross-section defined by opposed and angled surfaces 17 (i.e., the sides of the trough). The angled surfaces 17 form an acute angle relative to the top surface 13 of the light diffuser 116. In some embodiments, the angled surfaces 17 of the light diffuser 116 form an angle of approximately 45 degrees relative to the top surface 13. In other embodiments, the angled surfaces 117 of the light diffuser 116 form an angle of approximately 40, 35 or 30 degrees. In one example embodiment, the thickness of the light diffuser 116 measured from the top surface 13 to the bottom surface 15 is 1.05 mm. The depth of the V-shaped trough in the light diffuser 116 is 0.45 mm and the thickness from the bottom of the trough to the light incident surface 12 is 0.3 mm. The recess 11 within the bottom of the light diffuser 116 is 0.3 mm from the bottom surface 15. However, it is appreciated that alternate dimensions may be suitable, depending on the application.

As will be appreciated by persons skilled in the art, LEDs are a point source of light and the brightness of the backlighting depends on the distance of the respective key portion 106 from its LED 142. The light diversion features, such as the angular features 16, increase the brightness and light transmission efficiency provided by the light diffuser 116 but may be omitted in some embodiments. The omission of the angular features 16 may lower the brightness and light transmission efficiency; however, the effect on brightness and light transmission efficiency will be less with key assembly designs having lower LED to key (or key portion) ratios. For example, in the shown embodiment in which one LED 142 backlights two keys portions 106, the effect of omitting the angular features 16 would be relatively small. Omitting light diversion features, such as the angular features 16, may further reduce the overall thickness of the key assembly 102.

Referring now to FIGS. 9A and 10, a light guide provided by the key assembly 102 in accordance with one embodiment of the present disclosure will be described. The light guide directs light emitted by the LEDs 142 through the key assembly 102 and out of the keycap 104. The light guide is provided by the light diffusers 116, the flexible members 120, and keycap 104 of the key assembly 102. The general path of light rays emitted from the LEDs 142 is represented by light rays 18. Light rays 18 emitted from the LEDs 142 are received by the light incident surface 12 of the light diffuser 116 and then diffused within it. At least a portion of the light rays 18 diffused by the light diffuser 116 contact the angular features 16 which reflect and redirect the light rays 18 towards the light emitting surfaces 14. The angular features 16 are configured so as to cause diffuse light contacting them to be emitted through the light emitting surfaces 14 in a direction generally perpendicular to the direction of the light received from the LEDs 142. Light rays 18 emitted from the light emitting surfaces 14 are received by the adjacent light transmissive flexible members 120, causing the flexible members 120 to be illuminated. The illuminated flexible members 120 in turn emit light rays 18 which are received by the light transmitting portions 170 of the key portions 106 of the keycap 104, causing the light transmitting portions 170 to be illuminated in the respective predefined shapes.

The distance from the top of the LED 142 to the light incident surface 12 of the light diffuser 116 is referred to as the LED fire leading space and is represented in FIGS. 9A and 9B by the reference "d". The LED fire leading space "d" allows light emitted from each LED 142 to diverge, thereby increasing the surface area of the light incidence surface 12 which receives the light from the LEDs 142. The LED fire leading space may also provide mechanical tolerances for use in assembling the key assembly 102. In some embodiments, the key assembly 102 provides an LED fire leading space of 0.3 to 0.5 mm. In example embodiments in which the light diffuser 116 has a thickness of approximately 1.05 mm, this configuration results in a total distance of 1.05 mm to 1.25 mm from the top of the LED 142 to the top of the light diffuser 116. These distances and the LED leading space are a function of the light diffusing material and may vary between different designs. In addition, these distances and the LED leading space could vary depending on the space available for the light diffuser design.

In one example embodiment, the thickness of the light diffuser 116 measured from the top surface 13 to the bottom surface 15 is approximately 1.05 mm and is configured as described above and shown in FIG. 9A. The thickness of the light blocking film 118 is approximately 0.1 mm, the distance between the top of the light blocking film 118 to the bottom surface of the keycap 104 is approximately 0.4 mm, and the thickness of the keycap 104 is approximately 0.4 mm. This results in an overall thickness from the bottom surface 15 of the light diffuser 116 to the top surface of the keycap 104 of approximately 1.95 mm. The dome sheet 130 (approximately 0.07 mm), PCB 140 (approximately 0.13 mm) and backing plate 152 (approximately 0.1 mm) add approximately 0.3 mm to the overall thickness for a total thickness of approximately 2.25 mm for the fully assembled key assembly 102 compared with a typical thickness of at least 3 mm, but more commonly 4 mm or more, for a conventional keypad assembly with backlighting functionality. When the adhesive layers 156 and 158 are used, the overall thickness of the assembled key assembly 102 is increased by 0.07 mm for each adhesive layer for a total of an additional 0.14 mm. The recesses 160 result in locally enlarged portions on the back of the backing plate 152 of approximately 0.33 mm. These distances may vary between different designs.

FIG. 9B illustrates an alternative embodiment of the light diffuser 116 in which the angular features 116, i.e. the V-shaped trough shown in FIG. 9A, are omitted. This reduces the thickness of the light diffuser 116 to approximately 0.60 to 0.65 mm compared to the light diffuser 116 shown in FIG. 9A. The light diffuser 116 of the alternative embodiment maintains the recess 11 in its bottom surface 15, which could be approximately 0.3 mm in some embodiments. If the light diffuser 116 of the alternative embodiment were to replace the light diffuser 116 of FIG. 9A in the example embodiment described above, the overall thickness of the key assembly 102 (from the bottom surface 15 of the light diffuser 116 to the top surface of the keycap 104) would be approximately 1.55 mm when other features are kept the same.

In some embodiments, light blocking materials are used to prevent light from escaping around the outer boundary of the keycap 104 when assembled in the host electronic device 201. In some embodiments, the support member 114 is black or otherwise opaque to provide light blocking as well as support/stiffening of the key assembly 102. In some embodiments, the support member 114 and light diffusers 116 are comolded from a rigid plastic such as a polycarbonate using a two-shot injection molding process. A colorant is added to the molten plastic in one shot to form the support member 114 in black or another opaque colour. In some embodiments, the support member 114 is formed from black polycarbonate L1225L in one shot and the light diffusers 116 are formed from a translucent, light diffusing polycarbonate L1225L in the other shot. Either the light diffuser 116 or support member 114 can be formed in the first shot depending on the structure of the part design and tooling layout. In some embodiments, the support member 114, light diffusers 116, and flexible members 120 are comolded together during manufacture.

Example embodiments of a one-piece keycap 104 will now be described, as shown in FIGS. 2-5. As noted above, the keycap 104 has a plurality of hard key portions 106 separated by mechanically deforming portions 108. In some embodiments, the keycap 404 may be formed from a single piece of rigid plastic in which and the mechanically deforming portions 108 of the keycap 104 are defined by portions which are thinner than the key portions 106 of the keycap 104. The rigid plastic may be a right polycarbonate plastic such as polycarbonate L1225L. The mechanically deforming portions 108 may be defined by grooves in the keycap 104. The grooves may be formed on one side of the keycap 104, or on opposed sides of the keycap 104. In some embodiments, the mechanically deforming portions 108 are approximately 0.25 mm in thickness. While the mechanically deforming portions 108 may have a thickness which is relatively constant in some embodiments, the thickness of the keycap 104 may vary in other portions of the keycap 104 such as across and/or between the key portions 106. While an example thickness of the mechanically deforming portions 108 of some embodiments has been described, the thickness of the mechanically deforming portions 108 may vary between different embodiments, typically as a function of the material from which the keycap 104 is constructed, the overall thickness of the keycap 104, or both.

In the shown embodiment each key portion 106 is separated by respective mechanically deforming portions 108; however, in other embodiments more than one key portion 106 may be defined by respective mechanically deforming portions 108. For example, a pair of spaced apart mechanically deforming portions 108 may define a two-key pair having a toggle key construction as used by the two centre key portions 106 of the key assembly 102.

In some embodiments, the grooves may be provided on an externally facing side of the keycap 104 to provide the dual functions of mechanical deformation to allow for key presses of the respective key portions 106 of the keycap 104 and visual separation between key portions 106 of the keycap 104 for key identification by device users. In other embodiments, the grooves may be provided on the internally facing side of the keycap 104 to provide mechanical deformation to allow for key presses of the respective key portions 106 of the keycap 104. However, visual indications of the individual key portions 106 of the keycap 104 are provided by other means or omitted.

In other embodiments, the mechanically deforming portions 108 of the one-piece keycap 104 could be comprised of a flexible material and the key portions 106 of the one-piece keycap 104 could be comprised of a rigid material. The flexible material and rigid material are joined together to form an integrated part. In some embodiments, the mechanically deforming portions 108 may be formed of a flexible rubber and the key portions 106 formed of a rigid plastic such as polycarbonate which are joined together to form an integrated part, for example using comolding operations. Alternatively, the flexible material and rigid material could be joined in other ways.

The mechanically deforming portions 108 between adjacent rigid key portions 106 permit the respective rigid key portions to be individually depressed while providing a second linkage between keys provided by the rigid key portions 106 in addition to the linkage between keys provided by the flexible member(s) 120. This secondary linkage, in at least some embodiments, improves key stability, provides improved tactile feedback in response to key presses (i.e., firm key presses), and reduces the likelihood of damaging keys compared with individual keycaps. Accordingly, a key assembly having a one-piece keycap provides a relatively simple structure for constructing a keypad or keyboard with a plurality of keys.

While portions of the key assembly 102 are shown as separate elements, some of these elements may be combined in other embodiments or formed together using comolding in other embodiments. It is also possible that some of the elements described as a single element may be implemented using multiple elements in other embodiments.

While one embodiment of a key assembly 102 used in the construction of a control key panel or keypad of a handheld electronic device has been described above, it will be appreciated that in other embodiments the keypad may be located elsewhere or have a different number of keys. For example, while the key assembly 102 is shown as a single row of keys, the teachings of the present disclosure may be applied to the construction of any two or more adjacent keys, such as one or more rows or columns of keys, or other two-dimensional arrangement of keys. Moreover, while the key assembly 102 described above is used in the construction of a control key panel or keypad, the teachings of the present disclosure may be applied in the construction of a backlit numeric keypad, a telephone keypad based on the ITU standard (ITU E.161), a reduced keyboard or full keyboard (which could be configured in a familiar QWERTY, QWERTZ, AZERTY, or Dvorak layout known in the art). When constructed as a telephone keypad, a reduced keyboard or a full keyboard of an electronic device, the key assembly 102 could utilize the primary dome sheet and circuitry of the electronic device. In such embodiments, the number of LEDs and the ratio of keys to LEDs increases. For example, in a full keyboard implementation, the number of LEDs is typically limited to 10 but could be 8 or 6 or another suitable number. The light diffusers 116 are reconfigured to receive, diffuse and transmit light from the LEDs to the flexible member(s) carrying the actuators 124 and key gluing stems 122. This may require increasing the number and/or size of the light diffusers 116 for the telephone keypad, reduced keyboard or full keyboard of the electronic device.

Reference is now made to FIG. 11 which illustrates a handheld electronic device 201 in which example embodiments described in the present disclosure can be applied. The handheld electronic device 201 is a two-way communication device having data and voice communication capabilities, and the capability to communicate with other computer systems, for example, via the Internet. Depending on the functionality provided by the handheld electronic device 201, in various embodiments the device 201 may be a multiple-mode communication device configured for both data and voice communication, a smartphone, a mobile telephone or a PDA (personal digital assistant) enabled for wireless communication, or a computer system with a wireless modem.

The handheld electronic device 201 includes a rigid case (not shown) housing the components of the device 201. The internal components of the device 201 are constructed on, or connected via, a PCB (not shown). The handheld electronic device 201 includes a controller comprising at least one processor 240 (such as a microprocessor) which controls the overall operation of the device 201. The processor 240 interacts with device subsystems such as a wireless communication subsystem 211 for exchanging radio frequency signals with the wireless network 203 to perform communication functions. The processor 240 interacts with additional device subsystems including a display (screen) 204 such as a liquid crystal display (LCD) screen, a keypad 202 constructed using a key assembly in accordance with the present disclosure such as the key assembly 102, possibly other input devices (not shown), flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, short-range communication subsystem 262, and other device subsystems generally designated as 264. Some of the subsystems shown in FIG. 11 perform communication-related functions, whereas other subsystems may provide "resident" or on-device functions. In other embodiments, instead of the keypad 202, the handheld electronic device 201 may comprise a keyboard constructed using a key assembly in accordance with the present disclosure such as the key assembly 102.

The device 201 may comprise a touchscreen display in some embodiments. The touchscreen display may be constructed using a touch-sensitive input side connected to an electronic controller and which overlays the display screen 204. The touch-sensitive overlay and the electronic controller provide a touch-sensitive input device and the processor 240 interacts with the touch-sensitive overlay via the electronic controller.

The communication subsystem 211 includes a receiver 214, a transmitter 216, and associated components, such as one or more antenna elements 218 and 220, local oscillators (LOs) 222, and a processing module such as a digital signal processor (DSP) 224. The antenna elements 218 and 220 may be embedded or internal to the handheld electronic device 201 and a single antenna may be shared by both receiver and transmitter, as is known in the art. As will be apparent to those skilled in the field of communication, the particular design of the wireless communication subsystem 211 depends on the wireless network 203 in which handheld electronic device 201 is intended to operate.

The handheld electronic device 201 may communicate with any one of a plurality of fixed transceiver base stations (not shown) of the wireless network 203 within its geographic coverage area. The handheld electronic device 201 may send and receive communication signals over the wireless network 203 after the required network registration or activation procedures have been completed. Signals received by the antenna 218 through the wireless network 203 are input to the receiver 214, which may perform such common receiver functions as signal amplification, frequency down conversion, filtering, channel selection, etc., as well as analog-to-digital (A/D) conversion. A/D conversion of a received signal allows more complex communication functions such as demodulation and decoding to be performed in the DSP 224. In a similar manner, signals to be transmitted are processed, including modulation and encoding, for example, by the DSP 224. These DSP-processed signals are input to the transmitter 216 for digital-to-analog (D/A) conversion, frequency up conversion, filtering, amplification, and transmission to the wireless network 203 via the antenna 220. The DSP 224 not only processes communication signals, but may also provide for receiver and transmitter control. For example, the gains applied to communication signals in the receiver 214 and the transmitter 216 may be adaptively controlled through automatic gain control algorithms implemented in the DSP 224.

The processor 240 operates under stored program control and executes software modules 221 stored in memory such as persistent memory, for example, in the flash memory 244. As illustrated in FIG. 11, the software modules 221 comprise operating system software 223 and software applications 225. Those skilled in the art will appreciate that the software modules 221 or parts thereof may be temporarily loaded into volatile memory such as the RAM 246. The RAM 246 is used for storing runtime data variables and other types of data or information, as will be apparent to those skilled in the art. Although specific functions are described for various types of memory, this is merely one example, and those skilled in the art will appreciate that a different assignment of functions to types of memory could also be used.

In some embodiments, the handheld electronic device 201 also includes a removable memory card 230 (typically comprising flash memory) and a memory card interface 232. Network access is typically associated with a subscriber or user of the handheld electronic device 201 via the memory card 230, which may be a Subscriber Identity Module (SIM) card for use in a GSM network or other type of memory card for use in the relevant wireless network type. The memory card 230 is inserted in or connected to the memory card interface 232 of the handheld electronic device 201 in order to operate in conjunction with the wireless network 203.

The handheld electronic device 201 stores data 227 in an erasable persistent memory, which in one example embodiment is the flash memory 244. In various embodiments, the data 227 includes service data comprising information required by the handheld electronic device 201 to establish and maintain communication with the wireless network 203. The data 227 may also include user application data such as email messages, address book and contact information, calendar and schedule information, notepad documents, image files, and other commonly stored user information stored on the handheld electronic device 201 by its user, and other data. The data 227 stored in the persistent memory (e.g. flash memory 244) of the handheld electronic device 201 may be organized, at least partially, into a number of databases each containing data items of the same data type or associated with the same application. For example, email messages, contact records, and task items may be stored in individual databases within the device memory.

The handheld electronic device 201 also includes a battery 238 as a power source, which is typically one or more rechargeable batteries that may be charged, for example, through charging circuitry coupled to a battery interface 236 such as the serial data port 252. The battery 238 provides electrical power to at least some of the electrical circuitry in the handheld electronic device 201, and the battery interface 236 provides a mechanical and electrical connection for the battery 238. The battery interface 236 is coupled to a regulator (not shown) which provides power V+ to the circuitry of the handheld electronic device 201.

The short-range communication subsystem 262 is an additional optional component which provides for communication between the handheld electronic device 201 and different systems or devices, which need not necessarily be similar devices. For example, the subsystem 262 may include an infrared device and associated circuits and components, or a wireless bus protocol compliant communication mechanism such as a Bluetooth® communication module to provide for communication with similarly-enabled systems and devices.

The handheld electronic device 201 may provide two principal modes of communication: a data communication mode and an optional voice communication mode. In the data communication mode, a received data signal such as a text message; an email message, or Web page download will be processed by the communication subsystem 211 and input to the processor 240 for further processing. For example, a downloaded Web page may be further processed by a browser application or an email message may be processed by the email message messaging application and output to the display 204. A user of the handheld electronic device 201 may also compose data items, such as email messages, for example, using the input devices in conjunction with the display screen 204. These composed items may be transmitted through the communication subsystem 211 over the wireless network 203.

In the voice communication mode, the handheld electronic device 201 provides telephony functions and operates as a typical cellular phone. The overall operation is similar, except that the received signals would be output to the speaker 256 and signals for transmission would be generated by a transducer such as the microphone 258. The telephony functions are provided by a combination of software/firmware (i.e., the voice communication module) and hardware (i.e., the microphone 258, the speaker 256 and input devices). Alternative voice or audio I/O subsystems, such as a voice message recording subsystem, may also be implemented on the handheld electronic device 201. Although voice or audio signal output is typically accomplished primarily through the speaker 256, the display screen 204 may also be used to provide an indication of the identity of a calling party, duration of a voice call, or other voice call related information.

The various embodiments presented above are merely examples and are in no way meant to limit the scope of this disclosure. Variations of the innovations described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A key assembly for use in an electronic device, comprising:

a backing plate having a top surface which defines at least one recess;

a key subassembly located above the top surface of the backing plate, including:

a dome sheet having a number of dome switches on one side thereof;

a flexible member formed of a light transmissive material having opposed first and second sides, the flexible member having a plurality of key stems located on the first side and a plurality of actuators located on the second side opposite the key stems and adjacent to the dome switches for actuating them;

at least one keycap having a light transmitting portion attached to at least one of the key stems; and a flexible printed circuit board (PCB) received within the recess of the backing plate and connected to the dome sheet;

a light emitting diode (LED) connected to the PCB; and a light diffuser positioned opposite the LED having a light incident surface and at least one light emitting surface, wherein the light diffuser is configured to receive light from the LED when activated and direct the light towards the flexible member to illuminate it, wherein the illuminated flexible member emits at least a portion of the light received from the light diffuser through the light transmitting portion of the keycap to illuminate it.

2. The key assembly of claim 1, wherein the light diffuser has a bottom surface located opposite the LED which defines a recess in which the light incident surface is located.

3. The key assembly of claim 1, wherein the light diffuser includes light diversion features opposite the light incident surface, wherein the light diversion features are configured to direct light received from the LED to the light emitting surfaces which extends perpendicularly to the light incident surface.

4. The key assembly of claim 3, wherein the light diversion features are angular features formed in the top surface of the light diffuser opposite the light incident surface.

5. The key assembly of claim 1, wherein the keycap has a number of rigid key portions separated by mechanically deforming portions, each key portion being attached to one of the key stems.

6. The key assembly of claim 5, wherein each of the key portions has a light transmitting portion, wherein the light diffuser is configured to direct light received from the LED to two or more light emitting surfaces so as to illuminate two or more key stems and the light transmitting portions of the key portions to which the key stems are attached.

7. The key assembly of claim 5, wherein the mechanically deforming portions are thinner than the key portions of the keycap.

8. The key assembly of claim 5, wherein the mechanically deforming portions are defined by grooves in the keycap.

9. The key assembly of claim 5, wherein the key portions have an externally facing side and an opposed internally facing side attached to the plurality of key stems of the flexible member, wherein the grooves are provided on the externally facing side thereby providing a visual separation of the key portions.

10. The key assembly of claim 1, comprising a plurality of keycaps each attached to respective key stems, wherein each key has a light transmitting portion, wherein the light diffuser is configured to direct light received from the LED to two or more light emitting surfaces so as to illuminate two or more key stems and the light transmitting portions of the keys to which the key stems are attached.

11. The key assembly of claim 1, further comprising a support member surrounding at least a portion of each of the plurality of key stems.

12. The key assembly of claim 1, wherein the LED is located between at least some of the actuators.

13. The key assembly of claim 1, wherein the support member includes a plurality of support pins extending away from the keycap for supporting the key assembly and attaching the key assembly to the housing of the electronic device.

14. An electronic device, comprising:

a controller;

a key assembly, comprising;

a backing plate having a top surface which defines at least one recess;

a key subassembly located above the top surface of the backing plate, including:

a dome sheet having a number of dome switches on one side thereof;

a flexible member formed of a light transmissive material having opposed first and second sides, the flexible member having a plurality of key stems located on the first side and a plurality of actuators located on the second side opposite the key stems and adjacent to the dome switches for actuating them;

at least one keycap having a light transmitting portion attached to at least one of the key stems; and a flexible printed circuit board (PCB) received within the recess of the backing plate and connected to the dome sheet;

a light emitting diode (LED) connected to the PCB; and a light diffuser positioned opposite the LED having a light incident surface and at least one light emitting surface, wherein the light diffuser is configured to receive light from the LED when activated and direct the light towards the flexible member to illuminate it, wherein the illuminated flexible member emits at least a portion of the light received from the light diffuser through the light transmitting portion of the keycap to illuminate it;

wherein the controller being configured for receiving input signals in response to the actuation of the dome switches and for recognizing corresponding inputs in response to the received input signals.

15. The electronic device of claim 14, wherein the key assembly forms at least part of a keypad or keyboard of a handheld electronic device.

16. The electronic device of claim 14, wherein the light diffuser has a bottom surface located opposite the LED which defines a recess in which the light incident surface is located.

17. The electronic device of claim 14, wherein the light diffuser includes light diversion features opposite the light incident surface, wherein the light diversion features are configured to direct light received from the LED to the light emitting surfaces which extends perpendicularly to the light incident surface.

18. The electronic device of claim 17, wherein the light diversion features are angular features formed in the top surface of the light diffuser opposite the light incident surface.

19. The electronic device of claim 14, wherein the keycap has a number of rigid key portions separated by mechanically deforming portions, each key portion being attached to one of the key stems.

20. The electronic device of claim 19, wherein each of the key portions has a light transmitting portion, wherein the light diffuser is configured to direct light received from the LED to two or more light emitting surfaces so as to illuminate two or more key stems and the light transmitting portions of the key portions to which the key stems are attached.

21. The electronic device of claim 19, wherein the mechanically deforming portions are thinner than the key portions of the keycap.

22. The electronic device of claim 19, wherein the mechanically deforming portions are defined by grooves in the keycap.

23. The electronic device of claim 19, wherein the key portions have an externally facing side and an opposed internally facing side attached to the plurality of key stems of the flexible member, wherein the grooves are provided on the externally facing side thereby providing a visual separation of the key portions.

24. The electronic device of claim 14, comprising a plurality of keycaps each attached to respective key stems, wherein each key has a light transmitting portion, wherein the light diffuser is configured to direct light received from the LED to two or more light emitting surfaces so as to illuminate two or more key stems and the light transmitting portions of the keys to which the key stems are attached.

* * * * *